US007758476B2

(12) United States Patent
Chu

(10) Patent No.: US 7,758,476 B2
(45) Date of Patent: Jul. 20, 2010

(54) INFLATABLE CUSHION BAG FOR STRIKING

(75) Inventor: Yong S. Chu, Glendale, CA (US)

(73) Assignee: Fitness Botics

( * ) Notice: Subject to any disclaimer, the term of this patent is extended or adjusted under 35 U.S.C. 154(b) by 0 days.

(21) Appl. No.: 11/702,738

(22) Filed: Feb. 6, 2007

(65) Prior Publication Data

US 2008/0188360 A1 Aug. 7, 2008

(51) Int. Cl.
*A63B 69/20* (2006.01)

(52) U.S. Cl. ..... 482/86; 482/83

(58) Field of Classification Search ..... 482/83–90; 273/440.1; 473/422, 438; D21/787, 798; 5/644, 645, 655.3, 711, 712, 720
See application file for complete search history.

(56) References Cited

U.S. PATENT DOCUMENTS 547,730 A 10/1895 MacLearn
615,700 A 12/1898 Hess
660,466 A * 10/1900 Sawtell ..... 5/712
1,708,638 A * 4/1929 Smith ..... 473/442
2,184,453 A 12/1939 Hayes
2,197,545 A 4/1940 Bachman
2,741,780 A * 4/1956 Kimbrig ..... 5/711
2,919,747 A * 1/1960 Post ..... 428/102
3,029,109 A * 4/1962 Nail ..... 297/461
4,103,889 A * 8/1978 Lobur ..... 482/86
4,255,824 A * 3/1981 Pertchik ..... 5/630
4,329,748 A * 5/1982 Finkelstein ..... 5/683
4,459,714 A * 7/1984 Lin ..... 5/655.3
4,527,796 A * 7/1985 Critelli ..... 482/86
5,010,607 A * 4/1991 Sobie ..... 5/683
5,328,425 A * 7/1994 Knighton et al. ..... 482/87
5,437,590 A * 8/1995 D'Alto ..... 482/90
5,472,395 A * 12/1995 Trocchio ..... 482/83
5,535,463 A * 7/1996 Chiu ..... 5/681
5,561,873 A * 10/1996 Weedling ..... 5/713
5,624,358 A * 4/1997 Hestilow ..... 482/90
5,674,157 A * 10/1997 Wilkinson ..... 482/83
5,794,287 A * 8/1998 Chung ..... 5/687
5,845,353 A * 12/1998 Chow ..... 5/685

(Continued)

*Primary Examiner*—Loan H Thanh
*Assistant Examiner*—Daniel F Roland
(74) *Attorney, Agent, or Firm*—Clement Cheng

(57) ABSTRACT

An inflatable cushion bag for striking includes an outer wall and an inner wall that is positioned inside and longitudinally with the outer wall looped around the inner wall. A first radial wall is joined to each of and connects between the outer wall and the inner wall at a first end and is sealed so that free airflow is blocked at the first end. A second radial wall is joined to each of and connects between the outer wall and the inner wall at a second end and is sealed so that free airflow is blocked at the second end. At least one intermediate radial wall is placed longitudinally between the first radial wall and the second radial wall and transversely between the outer wall and the inner wall. The intermediate radial wall may have a small opening such as a hole with a diameter less than ½ inches or an equivalent so that the opening allows a slow airflow through the intermediate radial wall for inflating or deflating the bag and, when inflated, restricts airflow through the opening to give a shock absorber effect to make the outer wall an added cushion when punched or kicked.

11 Claims, 5 Drawing Sheets

U.S. PATENT DOCUMENTS 5,941,801 A * 8/1999 D'Alto ..... 482/90
6,035,470 A * 3/2000 Chow ..... 5/687
6,080,089 A * 6/2000 Nicholson ..... 482/83
6,106,443 A 8/2000 Kuo
6,131,219 A * 10/2000 Roberts ..... 5/644
6,183,399 B1 * 2/2001 Chen ..... 482/90
6,251,051 B1 * 6/2001 Chen ..... 482/83
6,261,210 B1 * 7/2001 Lishejkov et al. ..... 482/83
6,390,958 B1 * 5/2002 Chu ..... 482/90
6,402,775 B1 * 6/2002 Bieberich ..... 607/104
6,432,027 B1 * 8/2002 Haselrig ..... 482/83
6,464,621 B1 * 10/2002 Chen ..... 482/83
6,478,380 B2 * 11/2002 Ehrlich ..... 297/423.46
6,558,298 B2 5/2003 Fields
6,726,605 B2 * 4/2004 Chen ..... 482/87
6,790,167 B1 * 9/2004 Carlin et al. ..... 482/90
6,857,152 B1 * 2/2005 Chow ..... 5/681
6,893,384 B2 * 5/2005 Triani ..... 482/83
6,973,690 B2 * 12/2005 Muci et al. ..... 5/644
6,994,658 B2 * 2/2006 Laudenslager et al. ..... 482/83
7,044,895 B1 * 5/2006 Iglehart ..... 482/83
7,063,648 B1 * 6/2006 Brigham ..... 482/83
7,152,263 B1 * 12/2006 Delfs ..... 5/636
7,234,184 B2 * 6/2007 Yang ..... 5/712
7,269,866 B2 * 9/2007 Liu ..... 5/711
2002/0086776 A1 * 7/2002 Fields et al. ..... 482/83
2002/0115538 A1 * 8/2002 Wen ..... 482/83
2002/0138912 A1 * 10/2002 Minurri et al. ..... 5/712
2004/0009852 A1 * 1/2004 Chen ..... 482/86
2004/0097348 A1 * 5/2004 Laudenslager et al. ..... 482/86
2004/0152568 A1 * 8/2004 Triani ..... 482/83
2004/0176222 A1 * 9/2004 Mitchell ..... 482/83
2007/0099772 A1 * 5/2007 Fu et al. ..... 482/83

* cited by examiner

INFLATABLE CUSHION BAG FOR STRIKING

BACKGROUND OF THE INVENTION

1. Field of the Invention

This invention relates generally to the bags which are to be kicked and punched for fitness and technique training for activities such as boxing and martial arts.

2. Description of Related Art

Various boxing and striking bags have been available in the past and the present time. They use foam material or other cushion material to fill the bag and make the bag soft to receive strikes. However, often they are too big for packaging for shipping and costly to manufacture. Some bags use air as a filling means, but they look too bubbly after filling and do not utilize the air inside as a part of shock absorber.

SUMMARY OF THE INVENTION

The present invention teaches certain benefits in construction and use which give rise to the objectives described below.

The present invention is a bag to be used as a striking device that helps a user to develop her or his punching or kicking skill for fitness training and martial art techniques. The present invention can be deflated and folded to transfer or store away into places such as a closet or a space under a bed. A person may hold the bag while another person is striking it or the bag may be hung under a ceiling or a structure to be used. The bag can also be put on a pole with a self-standing stand or a pole fixed on a floor. A preferred embodiment includes an outer flexible wall that substantially maintains its size when subjected to a tensile stress, and an inner wall that is longitudinally placed inside the outer wall and is also a material same as or similar to the material of the outer wall. The embodiment also includes at least three radial walls that keep a space between the outer wall and the inner wall when the embodiment is inflated. The radial walls also create at least two separate chambers inside the bag that may totally block or control the amount of airflow from one chamber to another when the embodiment is kicked or punched. By trapping the air in each chamber or allowing a controlled airflow between the chambers within the structure, a desired degree of rigidity of the overall structure of the embodiment can be maintained and a desired degree of softness on the surface can be achieved for striking. The embodiment can be inflated using air or other compressible fluid.

A primary objective of the present invention is to provide an apparatus having advantages not taught by the prior art.

Another objective is to provide such a bag that can maintain a desired structural rigidity and shape using flexible materials and a compressible fluid such as air inside for striking.

Another objective is to provide such a bag that can offer a desired degree of softness on the surface when punched or kicked on the outer wall.

A further objective is to provide such a bag capable of having it folded when deflated so that it can be stored away in a compact space such as a closet space or a space under a bed frame.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

Figure 1A:
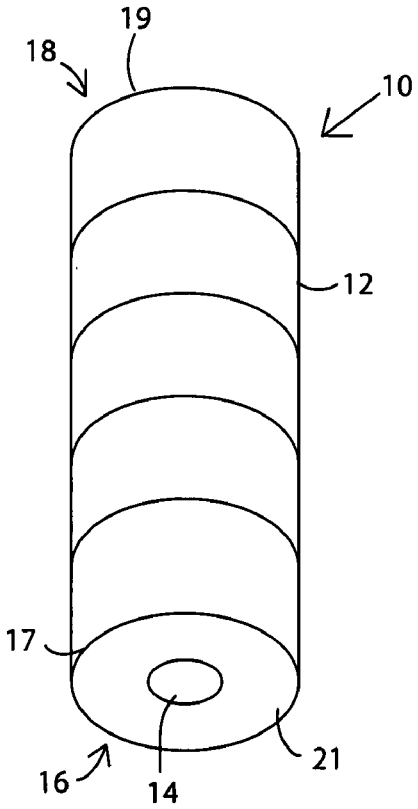
FIG. 1*a* is a perspective view of a preferred embodiment showing an outer wall, a first radial wall, and a portion of an inner wall.

The above described drawings FIGS. 1*a*-7*b* illustrate the invention, an inflatable cushion bag for striking, the bag 10 comprising: an outer wall 12, preferably of a material flexible but not stretchy when subjected to a tensile stress, providing a surface to receive strikes. Preferably the outer wall 12 is a substantially cylindrical or a longitudinal shape as shown in FIGS. 1*a* and 7*a* respectively. An inner wall 14 is placed inside the outer wall 12 and is substantially a cylindrical shape running along with the outer wall 12 as shown in FIG. 1*b* and 1*c*. A first radial wall 21 and a second radial wall 22 are placed between the outer wall 12 and the inner wall 14 at a first end 16 and a second end 18 of the outer wall 12 respectively. In the embodiment shown in FIG. 1*a*-1*c*, four intermediate radial walls 20 are placed between the first radial wall 21 and the second radial wall 22, but the number of intermediate radial walls may be changed depending on a desired softness on the outer surface and a degree of overall structural rigidity. The inner wall 14 is joined and sealed at its ends with the first radial wall 21 and the second radial wall 22 so that air cannot leak out from end seams 210, 220. Intermediate seam 200 joined by the inner wall 14 and the intermediate radial wall 20 respectively, can be sealed so that airflow may be blocked from one air chamber to another through the seam 200, or the intermediate seam may not be sealed to let some air passes through. Allowing an opening at the seam for the air to pass through from one chamber to another makes the chambers softer on their striking surface. Also sealed seam and unsealed seam may be combined in an embodiment so that the embodiment offers at least two different sections with different degrees of softness.

Figure 2A:
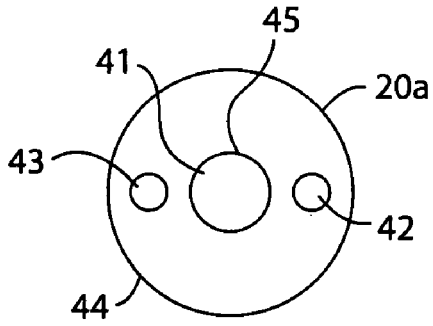
FIGS. 2*a*-2*e* are plan views of five different types of radial wall.
Figure 2B:
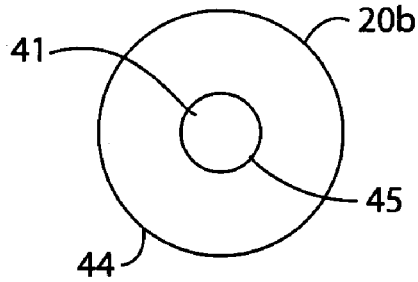
Figure 2C:
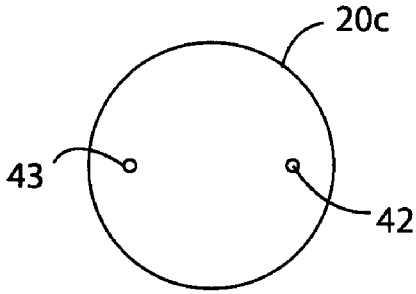
Figure 2D:
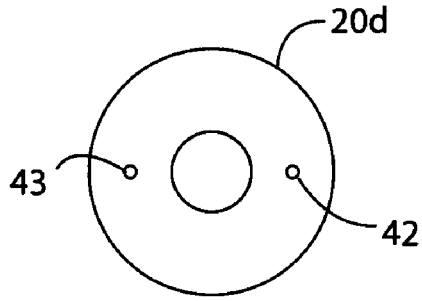
Figure 2E:
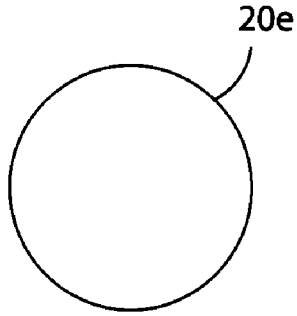
Figure 7A:
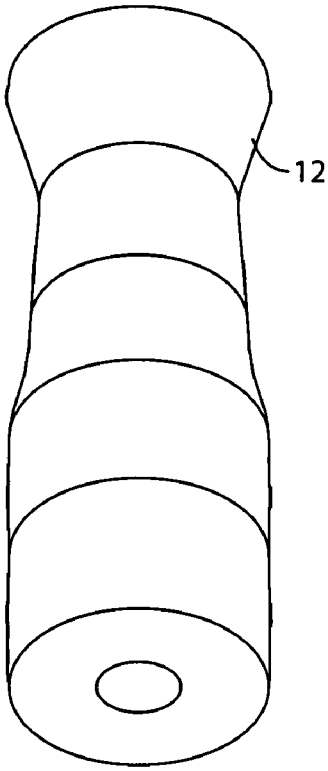
FIG. 7*a* is a perspective view of the embodiment with different size radial walls to give a unique shape on the outside.
Figure 7B:
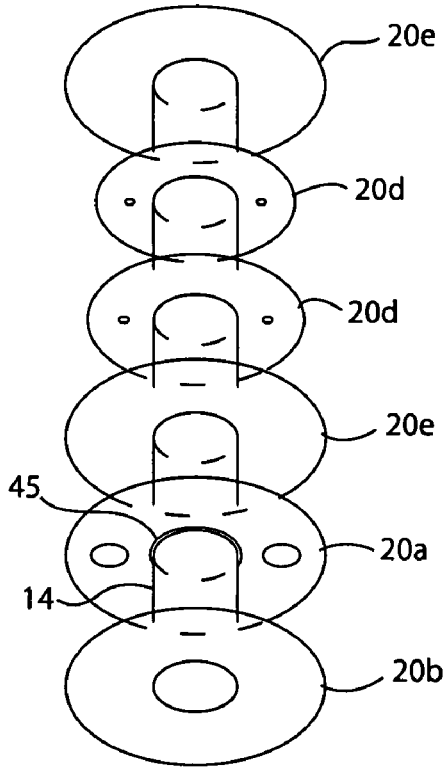
FIG. 7*b* is a perspective view of the embodiment showing different size radial walls in a structure without an outer wall shown.

In the same manner, the degree of softness of the bag 1 can be set by a possibility of having an opening for an airflow and controlling the amount of airflow through the opening in each of the intermediate radial walls 20. FIGS. 2*a*-2*e* show five different options of radial wall types 20*a*-20*e*, respectively, having a different opening pattern on each. Any of the intermediate radial walls 20 can be any of the options of radial wall types 20*a*-20*e* to block the airflow completely or to allow a controlled airflow from one chamber to another. The radial wall type 20a in FIG. 2*a* shows three holes 41, 42, 43. The hole 41 located about the center of the radial wall type 20*a* is to receive the inner wall 14 through the opening. An inner edge 45 around the hole 41 may be joined with and sealed against the inner wall 14. Or the inner edge 45 may not be joined and sealed against the inner wall 14 to allow some air movement as shown in FIG. 7*b*. The holes 42, 43 are for the air to pass through upon striking the bag 10, and the airflow may be controlled depending on the size of the holes 42, 43. The number of holes for air passage may also vary. The radial wall type 20*b* shows only one hole as opening, the hole 41. Using this option will allow the inner wall 14 to pass through and in case of having the inner edge 45 joined and sealed to the inner wall 14 the air passage is blocked between the two chambers separated by the radial wall type 20*b*. The radial wall type 20*e* in FIG. 2*e* shows no opening. Using the radial wall type 20*e* as an intermediate radial wall makes the inner wall 14 come to stop at the radial wall where the edge of the end of the inner wall 14 is joined and sealed against the radial wall. The radial wall type 20*d* in FIG. 2*d* shows also three holes as opening similar to the wall type 20*a* having the inner edge 45. But the holes 42, 43 respectively shown on the radial wall type 20*d* are relatively small compared to those in the radial wall type 20*a*, less than 0.5 inches in diameter each, to limit the airflow when the bag 1 is being struck but allow air to pass through slowly when the bag 10 is being inflated or deflated so that a single air inlet/outlet nipple may be used for supplying air to a number of chambers. A small opening, as shown on the radial wall type 20*d*, also acts as a shock absorber when air is being forced out through the small holes giving the bag 10 an added softness. The radial wall type 20*c* in FIG. 2*c* shows two small holes less than 0.5 inches in diameter each, the holes 42, 43 without having the opening for the inner wall 14 to pass through.

Figure 5A:
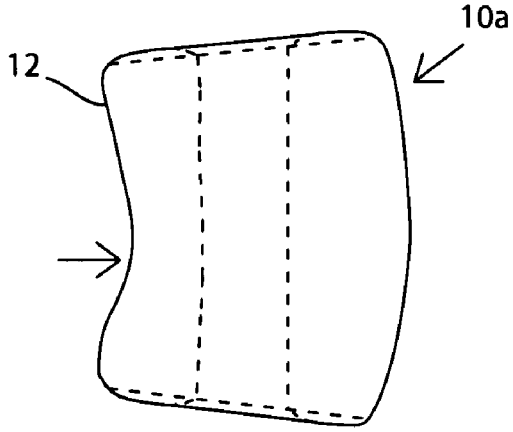
FIGS. 5*a* and 5*b* show a plan view of a bag without inner walls to show its behavior when it is stroke.

The degree of softness on the surface of the outer wall 12 is demonstrated in FIGS. 5*a*, 5*b*, 5*c*, and 5*d* depending on the internal structure of the bag. Given that two bags 10*a*, 10*b* shown in FIGS. 5*a* -5*d* having about the same outside dimensions, the bag 10*a* shown in FIGS. 5*a* and 5*b* has no intermediate radial walls whereas the bag 10*b* shown in FIGS. 5*c* and 5*d* has two intermediate radial walls. When the bag 10*a* shown in FIG. 5*a* is struck as indicated by an arrow pushing in a spot on the surface of the outer wall 12 and the air inside is pushed away from the spot to other areas of the internal space. When the same force of the strike is applied on the bag 10*b* shown in FIG. 5*c* that has three chambers inside, the air inside has less room to move away from the struck spot since the air is trapped inside one of the three chambers. Each chamber in the bag 10*b* is smaller than the single chamber in the bag 10*a* because of the given setting that the outside dimensions of the two bags are about the same. Even if there is a small opening on an immediate radial wall inside the bag 10*b* shown in FIG. 5*c*, it takes some time for the air to move from one side of the radial wall to the other through the opening. This effect makes the bag 10*b* with the intermediate radial walls more rigid in overall structure and the surface is less giving compared to the bag 10*a* shown in FIG. 5*a*. The intermediate radial walls should be spaced apart within the distance of the shortest diameter of the bag.

Figure 5B:
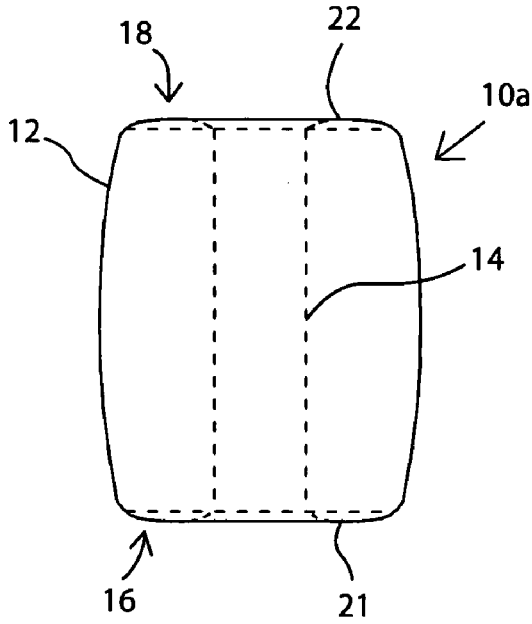
Figure 5C:
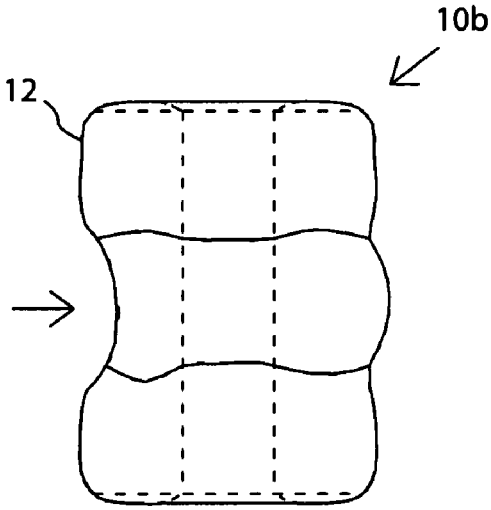
FIGS. 5*c* and 5*d* show a plan view of another bag with inner walls to compare its internal behavior to the bag shown in FIGS. 5*a* and 5*b*.
Figure 5D:
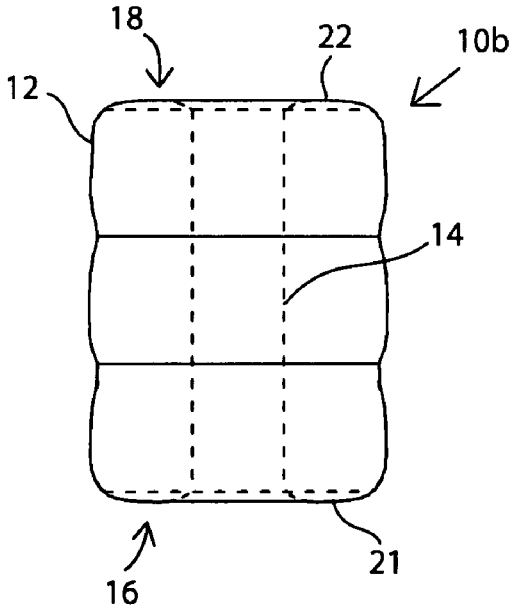

The outside shape of the bag 10*a* that does not have intermediate radial walls shown in FIG. 5*b* has an overall shape that is bowed out in the radial direction. The bag 10*b* shown in FIG. 5*c* has the outer wall 12 locally bowed out, but the overall shape is straighter than the bag 10*a* shown in FIG. 5*b*. In the same manner the radial walls 21, 22 at the ends 16, 18 respectively are also pulled in from bowing out using the inner wall 14 for both bags 10*a*, 10*b*. Therefore the bag having the intermediate radial walls and the inner wall is ideal for using martial arts and other sport training since it maintains a degree of structural rigidity and the overall shape, and gives the softness on the surface of the outer wall needed for striking when air is used for filling means inside the bag.

Figure 1B:
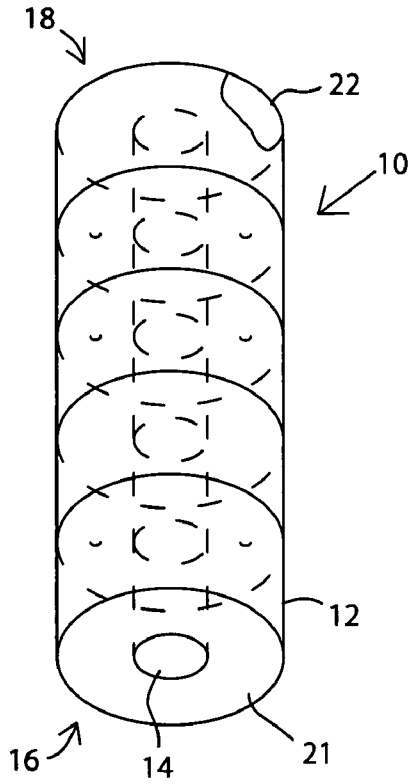
FIG. 1*b* is a perspective view of the preferred embodiment showing an outer wall, a number of radial walls, and an inner wall.
Figure 4:
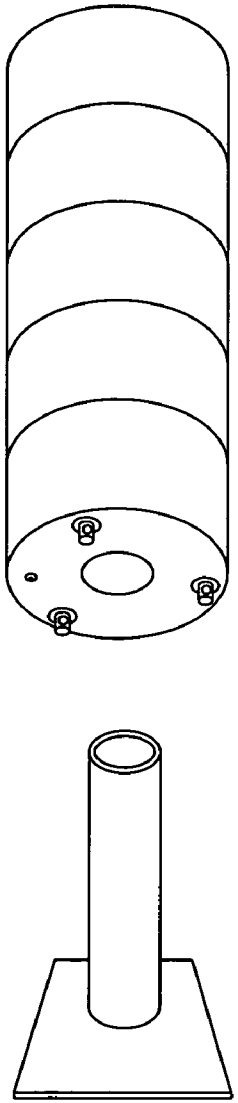
FIG. 4 is the embodiment to be used on a pole to support the bag.
Figure 3:
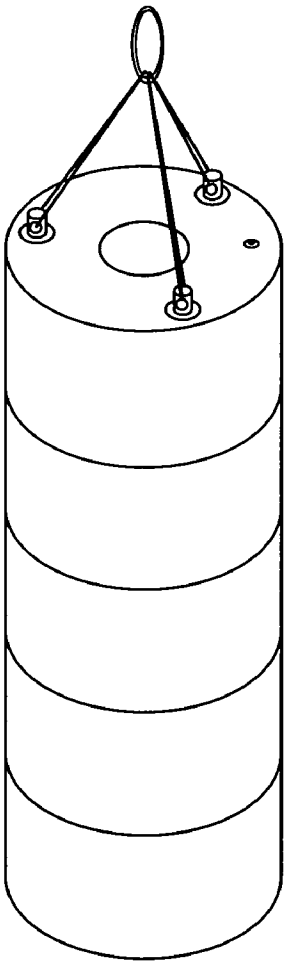
FIG. 3 is the embodiment shown with straps to hang it under a structure such as a ceiling.
Figure 6A:
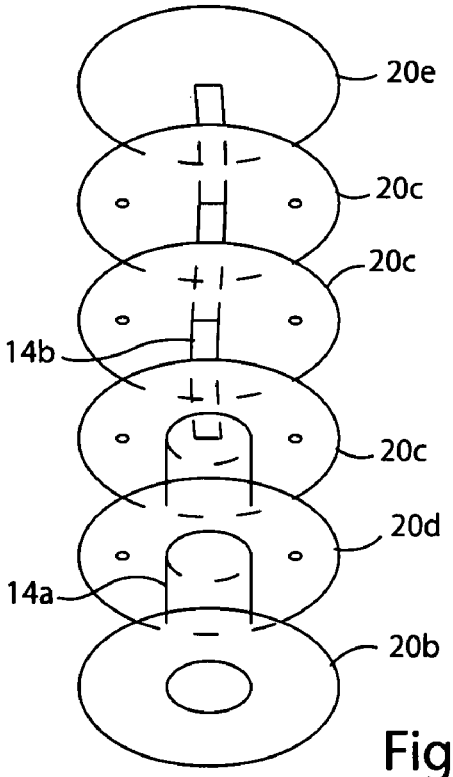
FIG. 6*a* is a perspective view of an embodiment showing an interior structure having an inner wall combining two different shapes.
Figure 6B:
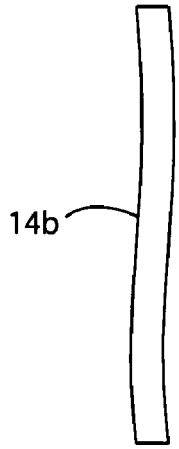
FIG. 6*b* is a plan view of an inner wall type.

At least two different inner wall types 14*a*, 14*b* are shown in FIG. 6*a*. The inner wall 14 shown in FIG. 1*b* is a cylindrical shape as the inner wall type 14*a* shown in FIG. 6*a*. The cylindrical shape with an open end on one side provides a room to add a substance that has a weight when the bag is hung under a structure to be used as shown in FIG. 3, or the bag can go on a pole as a standing structure as shown in FIG. 4. The inner wall 14 may also take a form of a flat tape shape such as the inner wall type 14*b* as shown in FIG. 6*b* or a form of a mixture of both inner wall types 14*a*, 14*b* as shown in FIG. 6*a*. However, the shape of the inner wall 14 should not be limited to only those longitudinal shapes shown in FIGS. 6*a* and 6*b*.

Figure 1C:
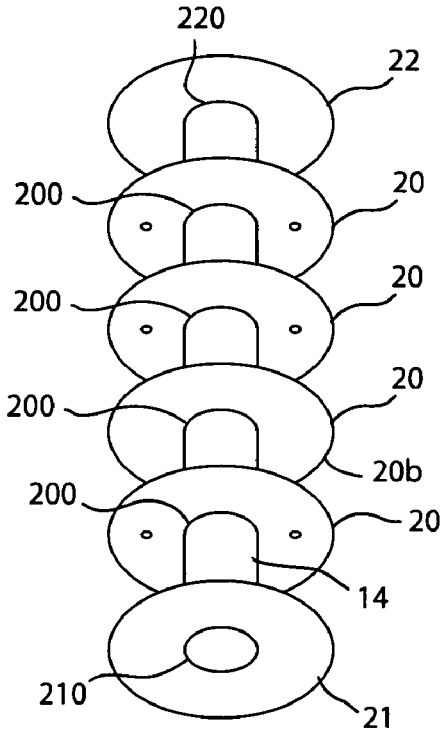
FIG. 1*c* is a perspective view of the embodiment showing an interior structure that includes an inner wall and a number of radial walls.

The outer wall 12 shown in FIG. 1*a* and 1*b* is a cylindrical shape. The outer wall 12 has an outer seam 17 joined between the outer wall 12 and the first radial wall 21 and an outer seam 19 between the outer wall 12 and the second radial wall 22 sealed so that air doesn't leak through the outer seams 17 and 19. The first and second radial walls 21 and 22 can be the radial wall type 20*b* or the radial wall type 20*e* as shown in FIGS. 2*b* and 2*e* respectively. With the inner seams 210 and 220 also sealed as shown in FIG. 1*c*, the bag 10 contains and holds the air inside once the bag 10 is inflated. The air inside may travel from one chamber to another separated by intermediate radial walls through the opening in the intermediate radial walls. Or the air can travel only within a section of the bag in case of the section separated by an intermediate radial wall that has a shape of the radial wall type 20*b* or 20*e*, as shown in FIGS. 2*b* and 2*e* respectively, which are completely sealed against the inner and outer walls. The embodiment, shown in FIG. 1*c*, has two sections separated by one of the intermediate radial walls 20 being the radial wall type 20*b*. At least one air inlet/outlet nipple is needed to inflate or deflate each section that may contain a number of air chambers.

The internal structure of an embodiment shown in FIG. 7*b* also indicates that the embodiment has two sections separated by the radial wall type 20*e*. The upper section has two intermediate radial walls 20 of the radial wall type 20*d* with both the outer and inner edges 44, 45 respectively sealed, and the lower section has one intermediate radial wall 20 of the radial wall type 20*a* with only the outer edge 44 sealed against the outer wall 12. The upper and lower sections have different softness: The upper section has a feel of a shock absorber, a slow bounce, and the lower section has a feel of a spring, a quick bounce, upon a strike. This kind of response control can be achieved only by using a fluid as filling means such as air and intermediate radial walls that creates chambers and sections in the bag.

FIG. 7*b* shows radial walls with different sizes in the embodiment without showing the outer wall 12. As a result the embodiment can take a shape other than a simple cylindrical form when the outer wall 12 is placed on. FIG. 7*a* shows the outer shape of the embodiment with the outer wall 12 placed on the internal structure shown in FIG. 7*b*. Likewise many different shapes of embodiments are possible depending on the size, the number, and different shapes of the outside edge, 44, of radial walls used. The possibility of the embodiment includes a shape substantially resembling a man or an upper part of the man.

It should be appreciated from the foregoing that the present invention provides an inflatable cushion bag for striking that is used as a bag held by a person while another person is striking or a bag that can be hung under a structure to be hit or a bag put on a pole on a stand or fixed on a floor. The bag offers a structure with a set degree of softness or different degrees of softness on different sections on the outer wall when punched or kicked, and yet offers an overall rigidity and shape maintenance when an inner wall and a number of radial walls made of flexible materials are used as an internal structure with air injected. The bag also offers a convenient storage when deflated. The bag includes an outer wall and an inner wall that is positioned inside and longitudinally with the outer wall looped around the inner wall. A first radial wall is joined to each of and connects between the outer wall and the inner wall at a first end and is sealed so that free airflow is blocked at the first end. A second radial wall is joined to each of and connects between the outer wall and the inner wall at a second end and is sealed so that free airflow is blocked at the second end. At least one intermediate radial wall is placed longitudinally between the first radial wall and the second radial wall and transversely between the outer wall and the inner wall. The intermediate radial wall may have a small opening such as a hole with a diameter less than ½ inches or an equivalent so that the opening allows a slow airflow through the intermediate radial wall for inflating or deflating the bag and, when inflated, restricts airflow through the opening to give a shock absorber effect to make the outer wall an added cushion when punched or kicked. The first radial wall, the second radial wall, and the intermediate radial walls may be of different sizes and shapes from each other on the outer edges that are joined to the outer wall so that the bag may take different shapes for various punching and kicking needs.

Although the invention has been disclosed in detail with reference only to the preferred embodiments, those skilled in the art will appreciate that various other embodiments can be provided without departing from the scope of the invention. Accordingly, the invention is defined only by the claims set forth below.

The invention claimed is:

1. An inflatable cushion bag for striking comprising:

a. an outer wall of flexible material;

b. an inner wall is placed inside the outer wall;

c. a first radial wall and a second radial wall are placed between the outer wall and the inner wall at a first end and a second end of the outer wall respectively, d. intermediate radial walls are placed between the first radial wall and the second radial wall; wherein the inner wall is joined and sealed at its ends with the first radial wall and the second radial wall so that air cannot leak out from end seams;

e. intermediate seams joined by the inner wall and the intermediate radial walls respectively, sealable so that airflow may be blocked between air chambers through the seam or not sealed to let some air pass, whereby allowing an opening at the seam for the air to pass through from one chamber to another makes the chambers softer on their striking surface, wherein a supporting pole fits through the first radial wall and the second radial wall, wherein the supporting pole fits inside the inner wall which is shaped to define a sleeve for receiving the supporting pole;

wherein the inner wall is shaped to define a cylindrical sleeve cavity passing through a central axis of the inflatable cushion bag;

wherein the intermediate radial walls further comprise at least one intermediate radial wall having an air passage hole for air communication between chambers.

2. The inflatable cushion bag for striking of claim 1, wherein the intermediate radial walls further comprise at least two intermediate radial walls having at least two air passage hole each for air communication between chambers, wherein at least a portion of an inner wall is shaped as a strip to join at least one intermediate radial wall to at least another intermediate radial wall, wherein the inner wall shaped as a strip provides vertical support between intermediate radial walls, wherein the inner wall is shaped at some portions of the inner wall to define a cylindrical sleeve cavity passing through a central axis of the inflatable cushion bag.

3. The inflatable cushion bag for striking of claim 1, further comprising a plurality of suspension wires connected to a plurality of wire connectors, connected to a main body of the inflatable cushion bag.

4. An inflatable cushion bag for striking comprising:

a. an outer wall of flexible material;

b. an inner wall is placed inside the outer wall;

c. a first radial wall and a second radial wall are placed between the outer wall and the inner wall at a first end and a second end of the outer wall respectively, d. intermediate radial walls are placed between the first radial wall and the second radial wall; wherein the inner wall is joined and sealed at its ends with the first radial wall and the second radial wall so that air cannot leak out from end seams;

e. intermediate seams joined by the inner wall and the intermediate radial walls respectively, sealable so that airflow may be blocked between air chambers through the seam or not sealed to let some air pass, whereby allowing an opening at the seam for the air to pass through from one chamber to another makes the chambers softer on their striking surface, wherein a supporting pole fits through the first radial wall and the second radial wall, wherein the supporting pole fits inside the inner wall which is shaped to define a sleeve for receiving the supporting pole, wherein the intermediate radial walls further comprise at least one smaller radius intermediate radial wall and at least one larger radius intermediate radial wall, wherein the outer wall of flexible material joining the at least one smaller radius intermediate radial wall to the at least one larger radius intermediate radial wall has a tapered profile;

wherein the intermediate radial walls further comprise at least one intermediate radial wall having an air passage hole for air communication between chambers.

5. An inflatable cushion bag for striking comprising:

a. an outer wall of flexible material;

b. an inner wall is placed inside the outer wall:, c. a first end wall and a second end wall are placed between the outer wall and the inner wall at a first end and a second end of the outer wall respectively;

d. intermediate horizontal walls are placed between the first end wall and the second end wall; wherein the inner wall is joined and sealed at its ends with the first end wall and the second end wall so that air cannot leak out from end seams;

e. intermediate seams joined by the inner wall and the intermediate horizontal walls respectively, sealable so that airflow may be blocked between air chambers through the seam or not sealed to let some air pass, whereby allowing an opening at the seam for the air to pass through from one chamber to another makes the chambers softer on their striking surface, wherein the intermediate horizontal walls further comprise at least one intermediate horizontal wall having an air passage hole for air communication between chambers; and f. wherein the air chambers are vertically stacked, wherein the inner wall is sleeve shaped forming a hollow cavity inside the outer wall, wherein the hollow cavity is vertically oriented and passes through the intermediate horizontal walls, wherein the intermediate horizontal walls further comprise at least one smaller radius intermediate horizontal wall and at least one larger radius intermediate horizontal wall, wherein the outer wall of flexible material joining the at least one smaller radius intermediate horizontal wall to the at least one larger radius intermediate horizontal wall has a tapered profile; and wherein the inflatable cushion bag is generally cylindrical in shape.

6. An inflatable cushion bag for striking comprising:

a. an outer wall of flexible material;

b. an inner wall is placed inside the outer wall;

c. a first end wall and a second end wall are placed between the outer wall and the inner wall at a first end and a second end of the outer wall respectively;

d. intermediate horizontal walls are placed between the first end wall and the second end wall; wherein the inner wall is joined and sealed at its ends with the first end wall and the second end wall so that air cannot leak out from end seams;

g. intermediate seams joined by the inner wall and the intermediate horizontal walls respectively, sealable so that airflow may be blocked between air chambers through the seam or not sealed to let some air pass, whereby allowing an opening at the seam for the air to pass through from one chamber to another makes the chambers softer on their striking surface, wherein the intermediate horizontal walls further comprise at least one intermediate horizontal wall having an air passage hole for air communication between chambers; and wherein the air chambers are vertically stacked, wherein the inner wall is sleeve shaped forming a hollow cavity inside the outer wall, wherein the hollow cavity is vertically oriented and passes through the intermediate horizontal walls, wherein the inner wall is shaped to define a cylindrical sleeve cavity passing through a central axis of the inflatable cushion bag.

7. An inflatable cushion bag for striking comprising:

a. an outer wall of flexible material;

b. an inner wall is placed inside the outer wall;

c. a first end wall and a second end wall are placed between the outer wall and the inner wall at a first end and a second end of the outer wall respectively;

d. intermediate horizontal walls are placed between the first end wall and the second end wall; wherein the inner wall is joined and sealed at its ends with the first end wall and the second end wall so that air cannot leak out from end seams;

h. intermediate seams joined by the inner wall and the intermediate horizontal walls respectively, sealable so that airflow may be blocked between air chambers through the seam or not sealed to let some air pass, whereby allowing an opening at the seam for the air to pass through from one chamber to another makes the chambers softer on their striking surface, wherein the intermediate horizontal walls further comprise at least one intermediate horizontal wall having an air passage hole for air communication between chambers; and wherein the air chambers are vertically stacked, wherein the inner wall is sleeve shaped forming a hollow cavity inside the outer wall, wherein the hollow cavity is vertically oriented and passes through the intermediate horizontal walls, further comprising a plurality of suspension wires connected to a plurality of wire connectors, connected to a main body of the inflatable cushion bag.

8. An inflatable cushion bag for striking comprising:

a. an outer wall of flexible material;

b. an inner wall is placed inside the outer wall;

c. a first end wall and a second end wall are placed between the outer wall and the inner wall at a first end and a second end of the outer wall respectively;

d. intermediate horizontal walls are placed between the first end wall and the second end wall; wherein the inner wall is joined and sealed at its ends with the first end wall and the second end wall so that air cannot leak out from end seams;

i. intermediate seams joined by the inner wall and the intermediate horizontal walls respectively, sealable so that airflow may be blocked between air chambers through the seam or not sealed to let some air pass, whereby allowing an opening at the seam for the air to pass through from one chamber to another makes the chambers softer on their striking surface, wherein the intermediate horizontal walls further comprise at least one intermediate horizontal wall having an air passage hole for air communication between chambers; and wherein the air chambers are vertically stacked, wherein the inner wall is sleeve shaped forming a hollow cavity inside the outer wall, wherein the hollow cavity is vertically oriented and passes through the intermediate horizontal walls, further comprising a supporting pole fit inside the inner wall and fit inside the hollow cavity.

9. The inflatable cushion bag for striking of claim 4, wherein the inner wall is shaped to define a cylindrical sleeve cavity passing through a central axis of the inflatable cushion bag.

10. The inflatable cushion bag for striking of claim 4, further comprising a plurality of suspension wires connected to a plurality of wire connectors, connected to a main body of the inflatable cushion bag.

11. The inflatable cushion bag for striking of claim 3, wherein the inner wall is shaped to define a cylindrical sleeve cavity passing through a central axis of the inflatable cushion bag.

* * * * *